US005975437A

United States Patent [19]

Streicher et al.

[11] Patent Number: 5,975,437

[45] Date of Patent: Nov. 2, 1999

[54] FUEL INJECTOR SOLENOID UTILIZING AN APERTURED ARMATURE

[75] Inventors: James J. Streicher, Pontiac; Marvin P. Schneider, East Peoria, both of Ill.

[73] Assignees: Caterpillar, Inc., Peoria, Ill.; Lucas Industries Public Limited Company, Solihull, United Kingdom

[21] Appl. No.: 08/963,144

[22] Filed: Nov. 3, 1997

[51] Int. Cl.[6] ..... B05B 1/32; F02M 51/00

[52] U.S. Cl. ..... 239/585.3; 239/533.9

[58] Field of Search ..... 239/585.1, 585.3, 239/585.2, 533.9; 251/129.15, 129.16, 129.21

[56] References Cited

U.S. PATENT DOCUMENTS

| | | | |
|---|---|---|---|
| 2,697,581 | 12/1954 | Ray | 251/129 |
| 2,820,604 | 1/1958 | Ray | 251/129 |
| 4,673,163 | 6/1987 | Kushida et al. | 251/129.1 |
| 5,104,046 | 4/1992 | Sakagami | 239/585.2 |
| 5,188,297 | 2/1993 | Asano | 239/585.3 |
| 5,192,048 | 3/1993 | Wakeman | 251/129.16 |
| 5,341,994 | 8/1994 | Wakeman | 239/585.5 |
| 5,419,369 | 5/1995 | House et al. | 251/129.21 X |
| 5,547,165 | 8/1996 | Brehm et al. | 251/129.16 |
| 5,560,549 | 10/1996 | Ricco et al. | 239/533.8 |
| 5,570,842 | 11/1996 | Kindley | 239/585.1 |
| 5,584,323 | 12/1996 | Yamamuro | 251/129.21 X |

FOREIGN PATENT DOCUMENTS

| | | |
|---|---|---|
| 1 236 062 | 6/1971 | United Kingdom . |
| 1 322 793 | 7/1973 | United Kingdom . |
| 1 364 565 | 8/1974 | United Kingdom . |
| 1 503 578 | 3/1978 | United Kingdom . |
| 1 598 295 | 9/1981 | United Kingdom . |
| 2 073 316 | 10/1981 | United Kingdom . |
| 2 178 483 | 2/1987 | United Kingdom . |
| WO 96/17166 | 6/1996 | WIPO . |

*Primary Examiner*—Lesley D. Morris
*Attorney, Agent, or Firm*—Marshall, O'Toole, Gerstein, Muray & Borun

[57] ABSTRACT

A fuel injector solenoid includes an armature through which a high pressure fuel passage extends. Because the fuel passage is disposed within the armature, the solenoid can be made larger, thereby permitting greater armature forces to be developed.

7 Claims, 6 Drawing Sheets

FUEL INJECTOR SOLENOID UTILIZING AN APERTURED ARMATURE

TECHNICAL FIELD

The present invention relates generally to fuel injection apparatus, and more particularly to a fuel injector utilizing an actuator in the form of a solenoid.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery to the associated engine cylinder.

Prior fuel injector designs have included high pressure fuel passages extending around a central recess containing a solenoid coil and a solenoid armature. Because the overall size of the fuel injector is limited, the size of the solenoid must also be limited, thereby undesirably reducing the available solenoid force. In addition, the high pressure fuel passage must include turns and bends in order not to intersect the solenoid recess, thereby complicating formation of the passages and requiring the use of plugs to seal off portions of the passages after formation. Because of the increase in the path length of the fuel passages, relatively large forces must be placed on the various parts in order to achieve proper sealing, thereby leading to part deflections which can undesirably affect the various components.

SUMMARY OF THE INVENTION

A fuel injector solenoid includes a fuel passage extending through an armature of the solenoid so that the solenoid can be made larger for a given injector envelope.

More particularly, in accordance with one aspect of the present invention, a fuel injector solenoid includes a stator having a solenoid coil therein, an armature adjacent the stator and a fuel passage separate from the armature and extending through the stator and the armature. The armature is movable about the fuel passage in response to current supply to the solenoid coil.

Preferably, the stator and armature define a central axis and the fuel passage is offset from the central axis. Also in accordance with the preferred embodiment, the fuel passage comprises a tube extending through the stator and an aligned bore in a body member extending through the armature. The tube is preferably placed in compression between the body member and a barrel.

In accordance with a preferred embodiment, a check spring is disposed in a spring recess and the fuel passage is disposed outside of the spring recess.

In accordance with an alternative embodiment, a check spring is disposed in a spring recess and the fuel passage is disposed inside the check spring.

In accordance with an alternative aspect of the present invention, a solenoid for a high pressure fuel injector includes an armature, a stator adjacent the armature on a first side thereof and having a solenoid coil therein and a body member adjacent the armature on a second side thereof opposite the first side. A fuel passage is separate from the armature and extends through the stator and the armature and includes a tube extending through the stator and an aligned bore in the body member. The stator and armature define a central axis and the fuel passage is offset from the central axis and the armature is movable about the fuel passage in response to current supplied to the solenoid coil.

The present fuel injector solenoid permits fuel lines to be made straighter and shorter, thereby simplifying fabrication thereof and leading to a desirable decrease in the force required to properly seal the parts. Undesired part deflections are, therefore, avoided. In addition, the size of the solenoid can be advantageously increased for a given injector envelope, and/or the size of the overall injector can be decreased, as desired.

BEST MODE FOR CARRYING OUT THE INVENTION

Figure 1:
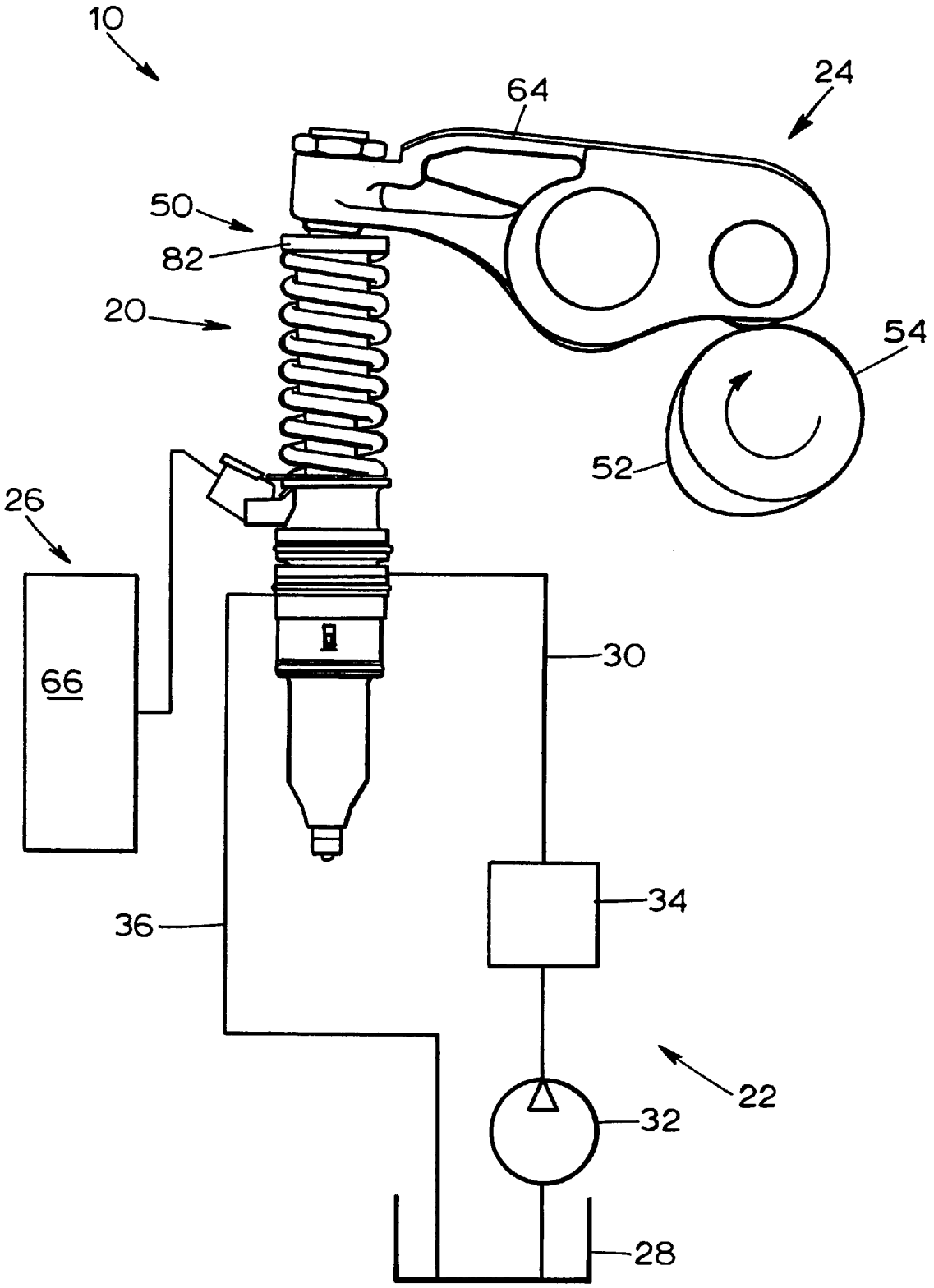
FIG. 1 is an elevational view of a fuel injector incorporating the present invention together with a cam shaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically actuated device or hydraulically actuated device. In the embodiment shown a tappet and plunger assembly 50 associated with the injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.)) and injecting the pressurized fuel into an associated cylinder. Although shown as a unitized injector 20, the injector could alternatively be of a modular construction wherein the fuel injection apparatus is separate from the fuel pressurization apparatus.

Figure 2:
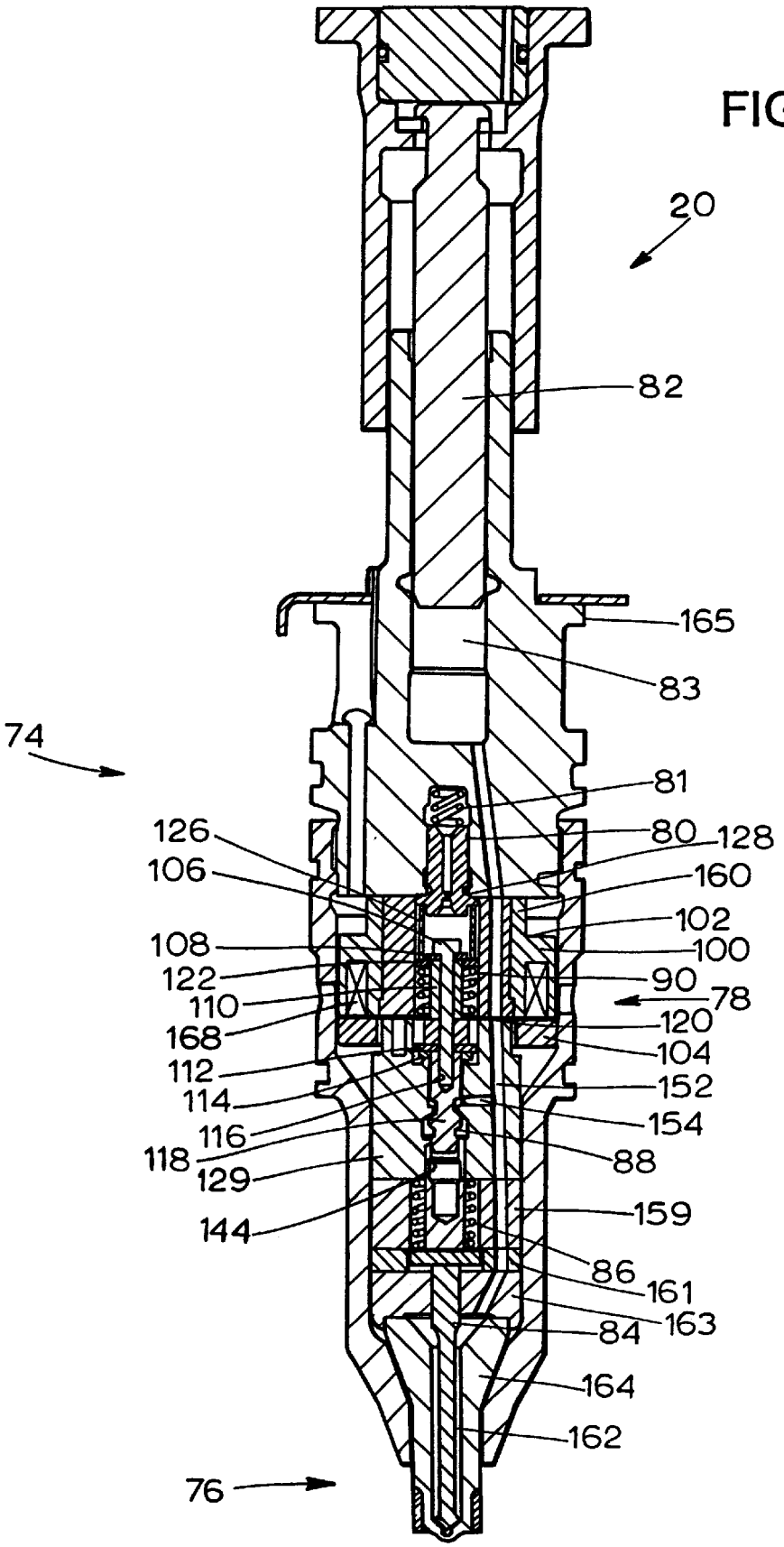
FIG. 2 is a sectional view of the fuel injector of FIG. 1.
Figure 3:
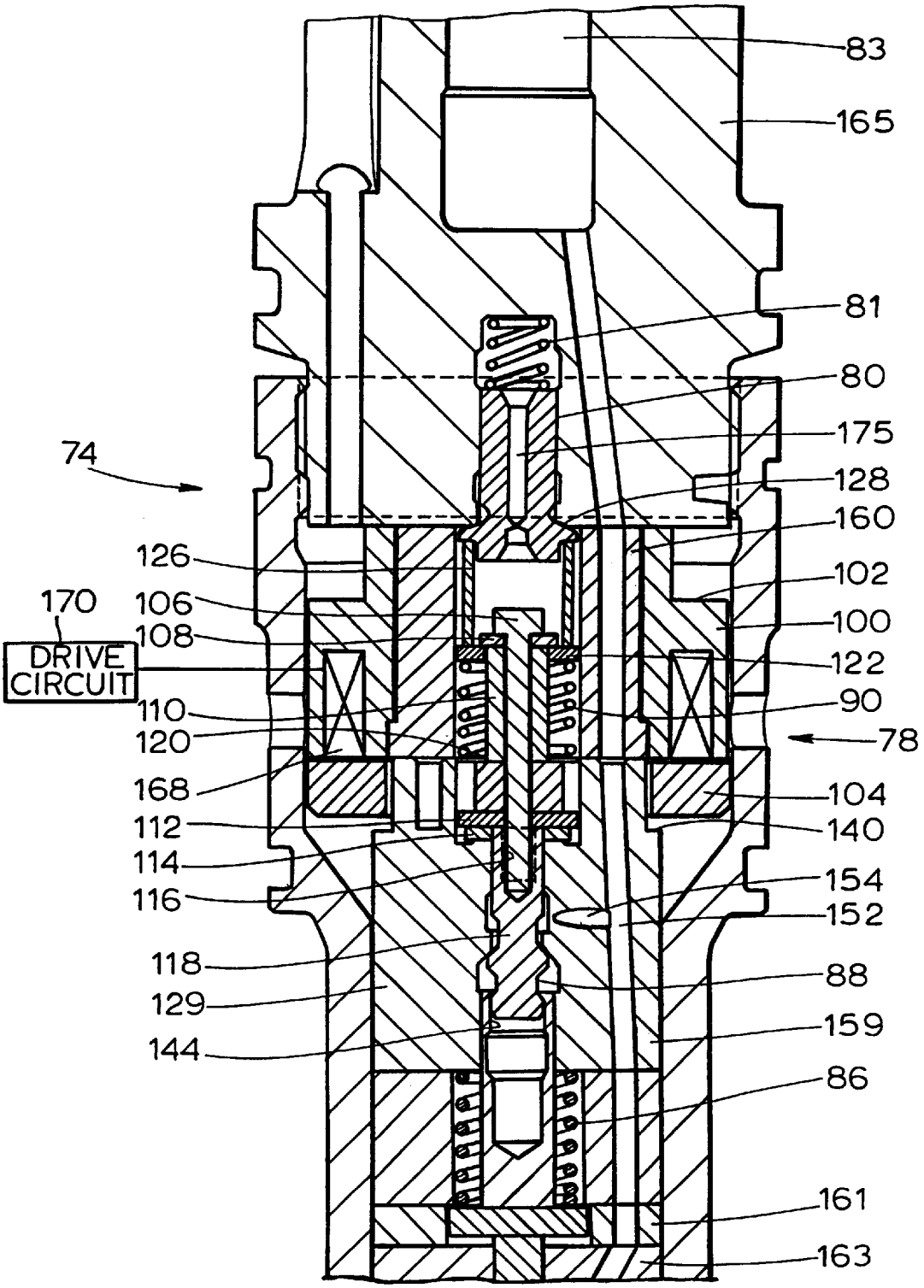
FIG. 3 is an enlarged, fragmentary sectional view of the fuel injector of FIG. 2 illustrating the solenoid, high pressure spill valve and DOC valve in greater detail.

Referring now to FIGS. 2 and 3, the injector 20 includes a case 74, a nozzle portion 76, an electrical actuator 78, a spill valve 80, a spill valve spring 81, a plunger 82 disposed in a plunger cavity 83, a check 84, a check spring 86, a direct operated check (DOC) valve 88 and a DOC spring 90. The spill valve spring 81 exerts a first spring force when compressed whereas the DOC spring 90 exerts a second spring force greater than the first spring force when compressed.

The electrical actuator 78 comprises a solenoid 100 having a stator 102 and an armature assembly in the form of a single armature 104. A bolt 106 and a washer 108 bear against a cylindrical member 110 which in turn bear against the armature 104. The bolt 106 further extends through a pair of additional washers 112, 114 into a threaded bore 116 in a valve stem or poppet 118 of the DOC valve 88. (The washer 114 also surrounds the poppet 118.)

The DOC spring 90 is placed in compression between a surface 120 of the armature 104 and a DOC spring preload spacer 122 which abuts the washer 108. A cylindrical spill valve spacer 126 is disposed between the spacer 122 and a shouldered portion 128 of the spill valve 80. The DOC spring preload spacer 122 is axially slidable over the cylindrical member 110.

Figure 5:
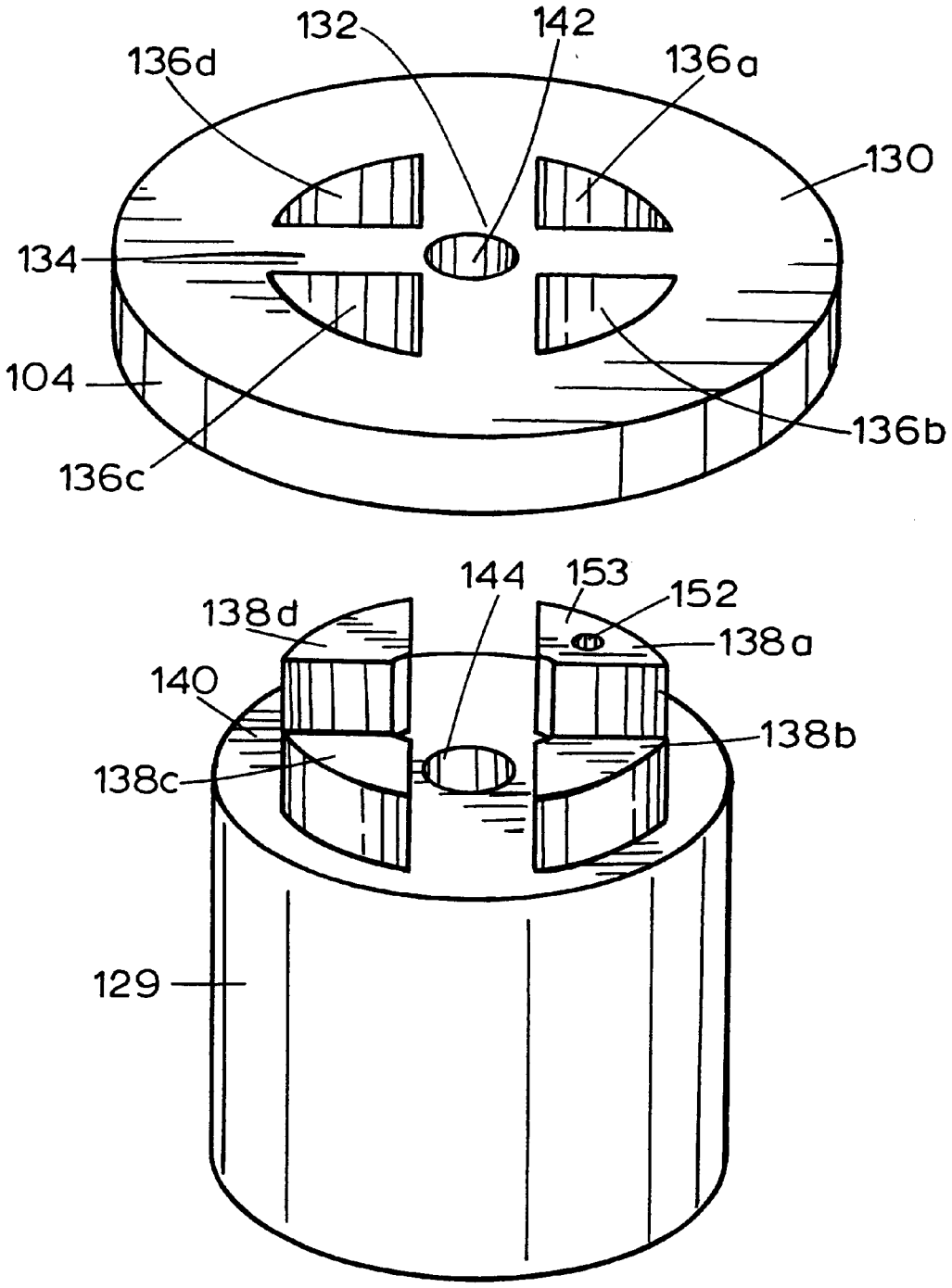
FIG. 5 is an exploded isometric view of the armature and DOC body member of FIGS. 3 and 4.

FIG. 5 illustrates the armature 104 in greater detail together with a DOC valve body member 129 which is located below the armature 104 as seen in FIGS. 2 and 3. Referring specifically to FIG. 5, the armature 104 has a spoked configuration including a cylindrical outer portion 130 and first and second cross legs 132, 134. First through fourth voids or spaces 136*a*–136*d* are formed between the cross legs 132, 134 and are of a size to accept mating protrusions 138*a*–138*d* formed on the DOC valve body member 129 and extending upwardly from an upper surface 140 thereof. This condition is shown in FIGS. 2 and 3.

If desired, a different number of voids or spaces may accept a like number of mating protrusions 138.

Referring again to FIG. 5, a central hole 142 in the armature 104 is aligned with a central bore or passage 144 in the DOC valve body member 129 which in turn receives the poppet 118 of the DOC valve 88.

As seen in FIGS. 2, 3 and 5, a fuel passage 152 extends through the DOC valve body member 129 and has an upper terminus at an upper surface 153 of the protrusion 138*a*. The DOC valve body member 129 further includes a cross passage 154 in fluid communication with the fuel passage 152 and the center bore 144.

The solenoid stator 102 surrounds a carrier 160 within which is disposed a high pressure fluid conduit 162. The conduit 162 has an inner diameter of substantially the same size as the inner diameter of the fuel passage 152 and is aligned therewith when the parts are assembled as shown in FIGS. 2 and 3. The carrier 160, the DOC valve body member 129, a body guide 159, first and second ring members 161, 163 and a tip member 164 are placed in compression between a barrel 165 and the case 74 so that the lower surface of the carrier 160 and the upper surfaces of the protrusions 138*a*–138*d* of the DOC valve body member 129 bear against one another with sufficient force to prevent leakage of fuel out of the conduit 162 and the fuel passage 152.

INDUSTRIAL APPLICABILITY

Figure 4:
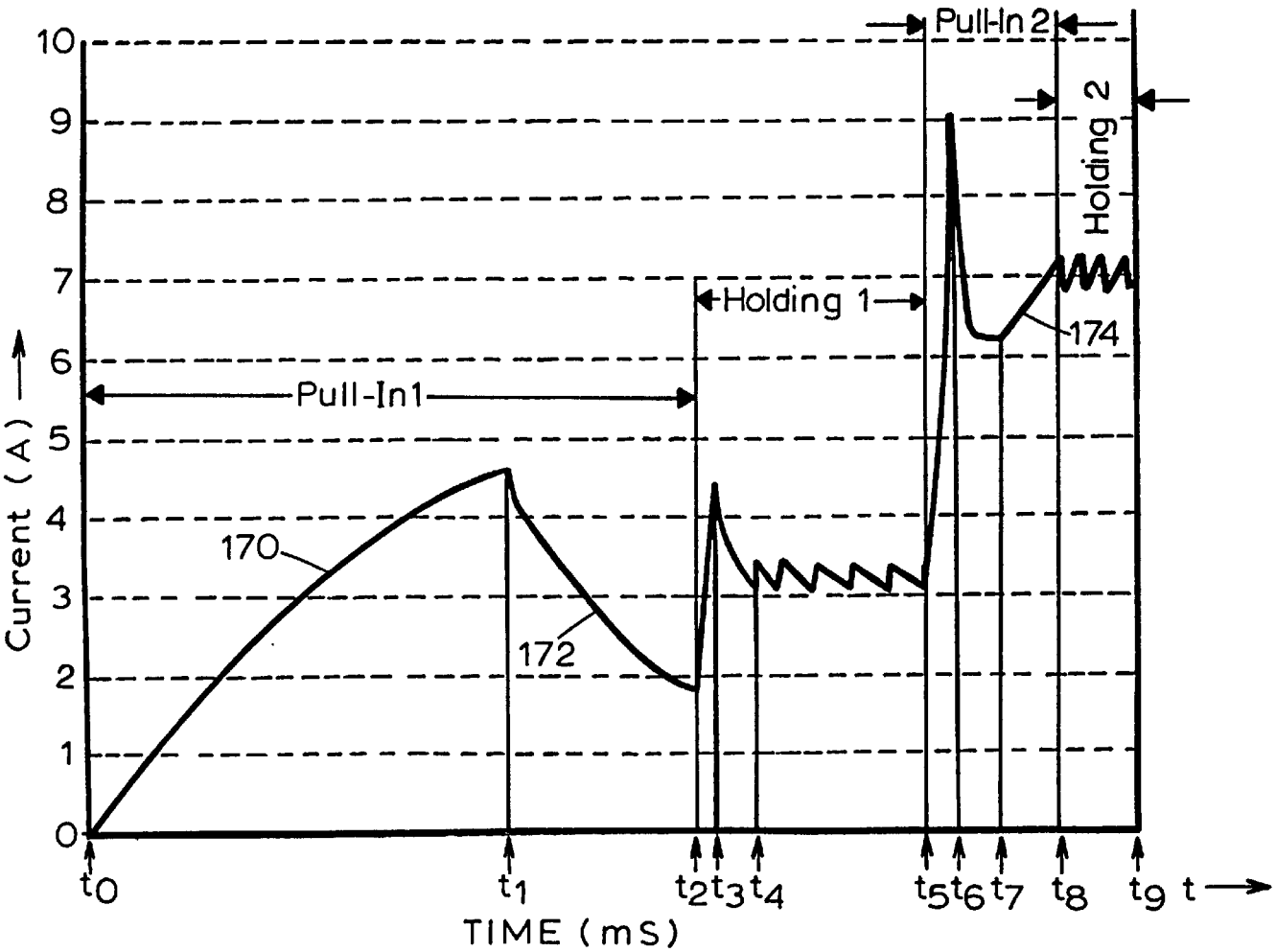
FIG. 4 is a waveform diagram illustrating current waveforms supplied to the solenoid coil of FIGS. 2 and 3.

Once assembled, the armature 104 is axially movable toward the solenoid stator 102 relative to the DOC valve body member 129 and the solenoid stator 102 in response to current supplied to a solenoid winding or coil 168 by a drive circuit 170. Specifically, referring also to FIG. 4, a first current waveform 172 is supplied to the winding 168, causing the armature 104 to overcome the force of the spill valve spring 81, but not the force exerted by the DOC spring 90. As a result, the spill valve 80 is moved upwardly to a closed position. Movement of the spill valve 80 is damped by fluid flowing through a damping orifice 175. Also, at this time, the DOC valve 88 is moved upwardly from a lower position to an intermediate position at which the DOC valve is still open. Thereafter, a second current waveform 174 of greater magnitude is supplied to the winding 168, causing the armature 104 to overcome the force of the DOC spring 90 and move the DOC valve 88 upwardly from the intermediate position to an upper, closed position. During movement of the armature 104, fluid present in the space about the armature 104 can flow in the spaces 136*a*–136*d* between the cross arms 132, 134 and the protrusions 138*a*–138*d*. Therefore, the armature 104 can move quickly to permit rapid injector operation.

The present invention provides the following benefits:

1) The high pressure fuel passages extend through the armature, thereby allowing the solenoid and armature to have a greater diameter and thereby resulting in maximum solenoid force for a given injector envelope;
2) The total surface area of the DOC valve body member 129 bearing against the carrier 160 is reduced as compared with previous designs, thereby leading to a reduction in the sealing force required;
3) Because the fuel path is kept straight and relatively short, the deflection of parts under the combined forces exerted during assembly and operation can be minimized;
4) The voids 136*a*–136*d* between the cross arms 132, 134 provide drain paths, and hence no separate bores are needed for such purpose;
5) The voids 136*a*–136*d* further permit the armature 104 to move quickly through the fluid without the need for other openings to accomplish this result.

Figure 6:
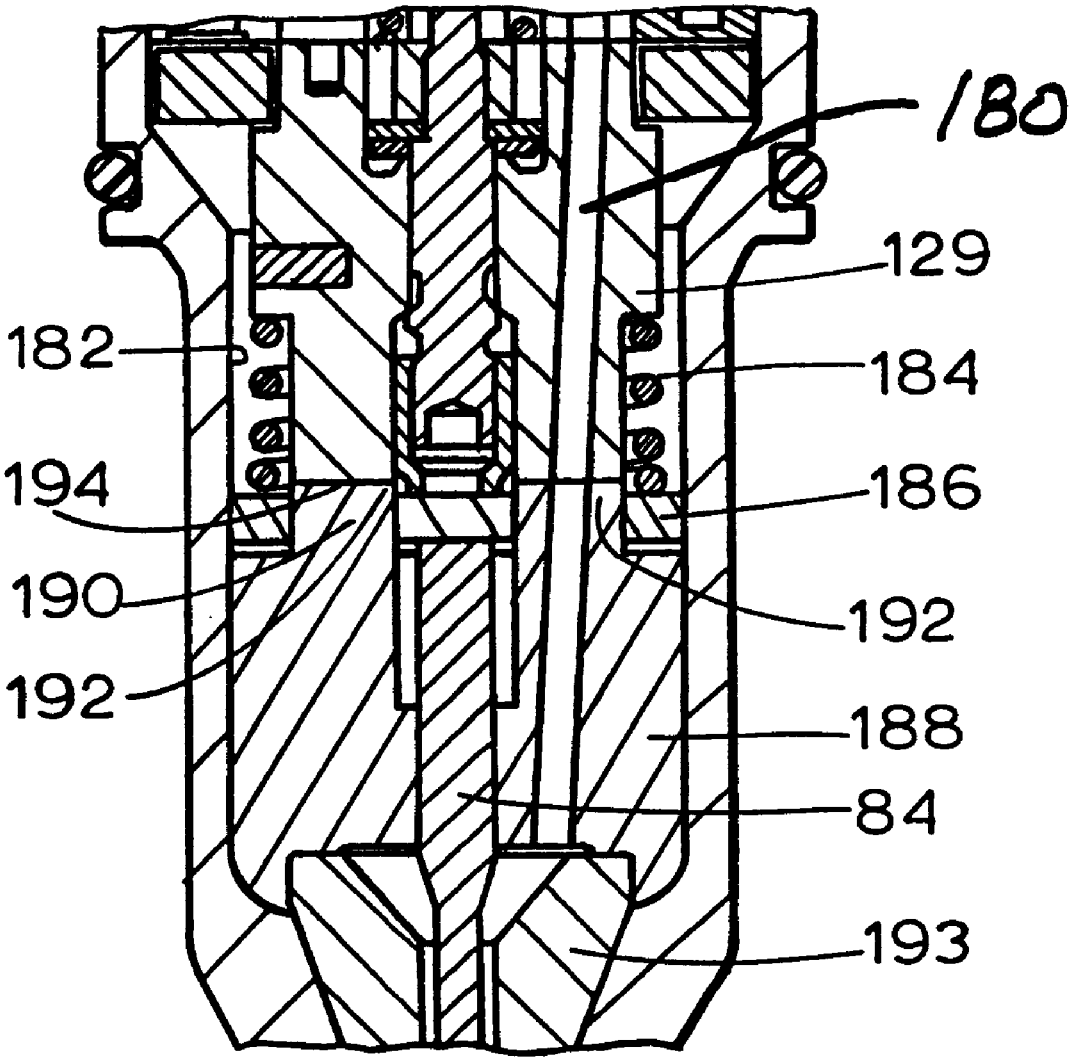
FIG. 6 is an enlarged, fragmentary sectional view of an embodiment of the present invention.

If desired, the design shown in FIGS. 2 and 3 may be modified as shown in FIG. 6 such that the fuel flows through a passage 180 disposed inside a spring recess 182 containing a check spring 184 in the body guide 159. The check spring 184 bears against a spoked drive member 186 similar to the armature 104 and which bears against the check 84. A body guide 188 includes an upper portion 190 having protrusions 192 similar to the protrusions 138 of the DOC valve body member 129. The body guide 188 is placed in sealing compression between a tip member 193 and the DOC valve body member 129 such that upper surfaces of the protrusions 192 bear against a lower surface 194 of the DOC valve body member 129. Further, the protrusions 192 extend through openings in the spoked drive member 186 and the passage 180 extends through one of the protrusions 192 and through the remainder of the body guide 188 to the passage containing the check 84. Because the fuel passage 180 is disposed within the spring recess 182, a further advantageous reduction in injector size can be achieved. Still further, a larger check spring can advantageously be used.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector, comprising:

a stator having a solenoid coil therein;

an armature adjacent the stator; and a fuel passage separate from the armature and extending through the stator and the armature, the fuel passage comprising a tube extending through the stator and an aligned bore in a body member extending through the armature and wherein the tube is placed in compression between the body member and a barrel;

wherein the armature is movable about the fuel passage in response to current supplied to the solenoid coil.

2. The fuel injector of claim 1, wherein the stator and armature define a central axis and wherein the fuel passage is offset from the central axis.

3. A fuel injector, comprising:

a stator having a solenoid coil therein;

an armature adjacent the stator; and a fuel passage separate from the armature and extending through the stator and the armature;

wherein the armature is movable about the fuel passage in response to current supplied to the solenoid coil;

wherein a check spring is disposed in a spring recess and the spring recess is disposed in a body guide and wherein the fuel passage is disposed outside of the check spring.

4. A fuel injector, comprising:

a stator having a solenoid coil therein;

an armature adjacent the stator; and a fuel passage separate from the armature and extending through the stator and the armature;

wherein the armature is movable about the fuel passage in response to current supplied to the solenoid coil;

wherein a check spring is disposed in a spring recess and the spring recess is disposed in a body guide and wherein the fuel passage is disposed inside of the check spring.

5. A fuel injector, comprising:

an armature;

a stator adjacent the armature on a first side thereof and having a solenoid coil therein;

a body member adjacent the armature on a second side thereof opposite the first side; and a fuel passage separate from the armature and extending through the stator and the armature, the fuel passage including a tube extending through the stator and an aligned bore in the body member wherein the tube is placed in compression between the body member and a barrel;

wherein the stator and armature define a central axis and the fuel passage is offset from the central axis and wherein the armature is movable about the fuel passage in response to current supplied to the solenoid coil.

6. The fuel injector of claim 5, wherein a check spring is disposed in a spring recess and the spring recess is disposed in a body guide and wherein the fuel passage is disposed outside of the check spring.

7. The fuel injector of claim 5, wherein a check spring is disposed in a spring recess and the spring recess is disposed in a body guide and wherein the fuel passage is disposed inside the check spring.

* * * * *